United States Patent [19]

Hoy

[11] Patent Number: 4,949,980

[45] Date of Patent: Aug. 21, 1990

[54] RESETTABLE TARGET ARRAY

[76] Inventor: James C. Hoy, Box 218AB, R.D. 4, Reading, Pa. 19606

[21] Appl. No.: 449,558

[22] Filed: Dec. 12, 1989

[51] Int. Cl.[5] ..... F41J 7/04

[52] U.S. Cl. ..... 273/391

[58] Field of Search ..... 273/388, 390, 391, 392

[56] References Cited

U.S. PATENT DOCUMENTS

| | | | |
|---|---|---|---|
| 157,335 | 12/1874 | Lyon | 273/390 X |
| 967,712 | 7/1911 | Harper | 273/392 |
| 1,162,814 | 12/1915 | Sommerfeld | 273/388 |
| 1,348,540 | 8/1920 | Briggs | 273/388 |
| 2,561,733 | 7/1951 | Foyst | 273/391 X |
| 2,905,469 | 9/1959 | Taylor | 273/388 X |
| 2,967,712 | 1/1961 | Breitenfeldt | 273/388 |
| 3,411,784 | 11/1968 | Lawrence | 273/388 |
| 4,524,976 | 6/1985 | Seitz et al. | 273/391 X |
| 4,550,918 | 11/1985 | Motsenbocker | 273/391 X |
| 4,588,194 | 5/1986 | Steidle et al. | 273/391 |

*Primary Examiner*—William H. Grieb

*Attorney, Agent, or Firm*—Leonard Quittner

[57] ABSTRACT

A target array is comprised of a multiplicity of upright target assemblies. When an upright first target is struck by a projectile, the target pivots to a knocked down position and is held by a latch. A second depending reset target when struck by a projectile moves to unlatch the knocked down target which returns to the upright position.

3 Claims, 4 Drawing Sheets

RESETTABLE TARGET ARRAY

CROSS-REFERENCES

There are no cross-references to, nor are there any related applications.

FEDERALLY-SPONSORED RIGHTS

The invention herein was made without any Federal sponsorship or contribution.

BACKGROUND OF THE INVENTION

1. The Field of the Invention

The field of the invention relates to an improved array of upright targets to be struck by projectiles as from a gun wherein the knocked down targets may be reset upright by striking another target.

2. Description of the Prior Art

The prior art is best demonstrated by U.S. Pat. No. 3,411,784, (June 1966, to Lawrence), U.S. Pat. No. 4,524,976 (June, 1986, to Seitz, et al), U.S. Pat. No. 4,550,918 (Nov. 1985, to Motsenbocker), U.S. Pat. No. 157,335 (Dec. 1874, to Lyon), U.S. Pat. No. 1,348,540 (Aug. 1920 to Briggs), U.S. Pat. No. 2,561,733 (Apr. 1949 to Foyst), U.S. Pat. No. 2,967,712 (July 1959 to Breitenfeldt) and U.S. Pat. No. 1,162,814 (Dec. 1915 to Sommerfeld); all of which disclose target arrays which are resettable. '784 discloses an array of depending targets which when struck oppose gravity by pivoting upward onto a stop. When the stop is shifted by a reset target, the depending targets conform to gravity and swing downward into the reset position. To be fully effective, that is to oppose gravity, a target must absorb full impact from the striking projectile. However, in so doing, the force creating the upward pivoting action may be such that when a target strikes the stop there may be sufficient energy remaining to cause the target to rebound and reset itself. '976 teaches a similar mechanism which utilizes a magnetic field and damping means to absorb the upward force.

None of the prior art solves the problem of preventing a struck target from resetting itself.

SUMMARY OF THE INVENTION

The invention described herein is summarized as a resettable upright target array comprised of metal target assemblies having first targets on first pivoting target arms. When a target in the array is struck by a projectile it is driven arctuately downward on the pivot past a latching means which locks the target in the knocked down position. The force of the impact on the assembly and the pivoting action loads a torsion spring adjacent and cooperating with the arm.

A second depending reset target situated below the array when struck by a projectile will be driven arctuately upward on a second pivoting arm. Such movement causes a clearing bar situated above the second arm to lift, thereby unlatching the first arm and releasing the load spring to cause the first arm to pivot uprightly to reset the target.

An object of the invention is to provide a resettable array of upright targets which can be reset by striking a reset target.

A further object of the invention is to provide a resettable target which when knocked down can not become reset without the intervention of independent resetting means.

Other objects, advantages and features of the present invention will be apparent to those skilled in the art from the following description taken in conjunction with the accompanying drawings.

DESCRIPTION OF DRAWINGS

The present invention may be better understood by reference to the drawings wherein 4 figures are shown on 4 sheets. The numbers shown on the drawings for the various parts of the invention are consistent throughout so that a number indicating a part in one drawing will indicated the same part in another drawing.

DESCRIPTION OF THE PREFERRED EMBODIMENT

Figure 1:
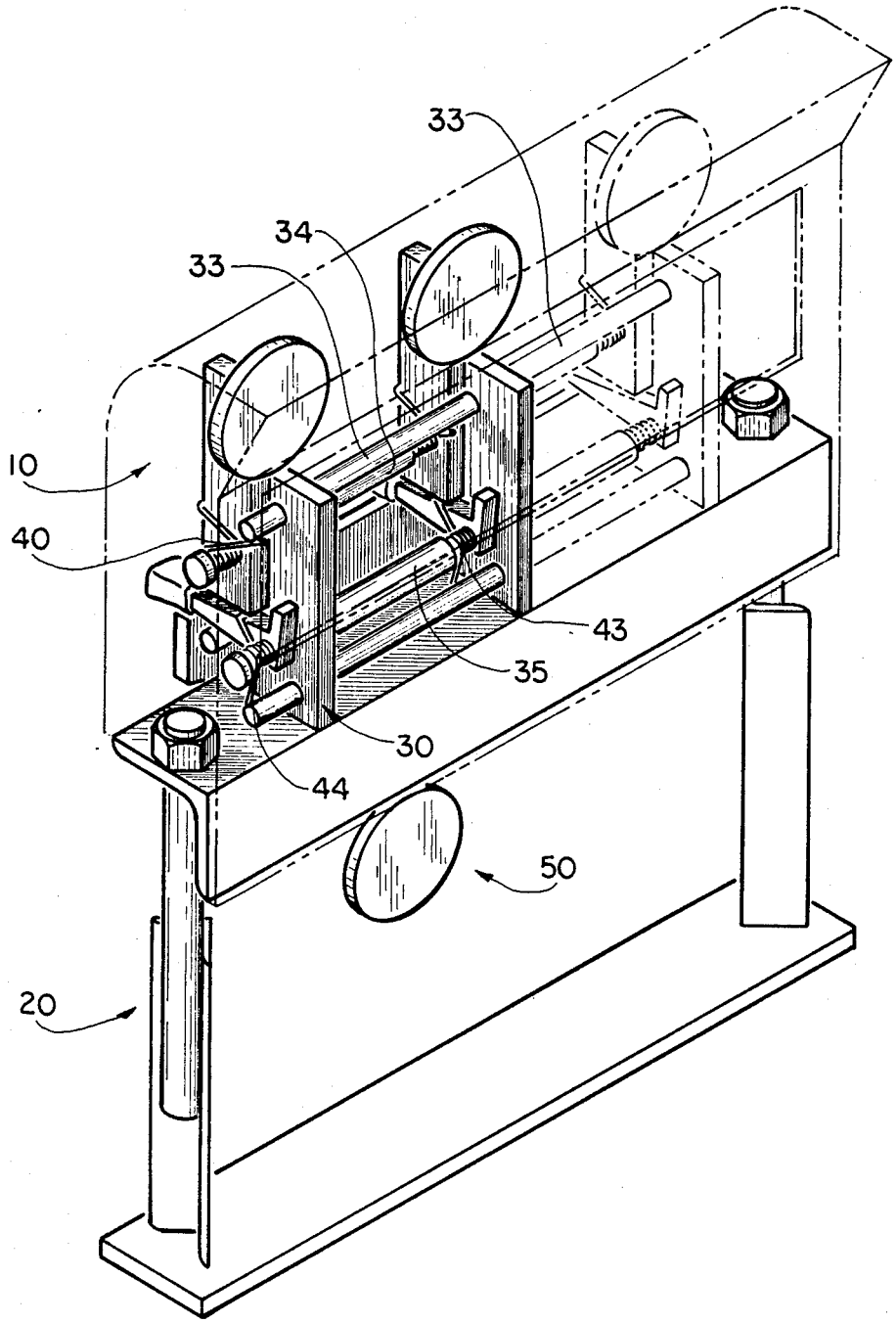
FIG. 1 depicts a front perspective view of the invention showing a target array of the invention in the set position.
Figure 2:
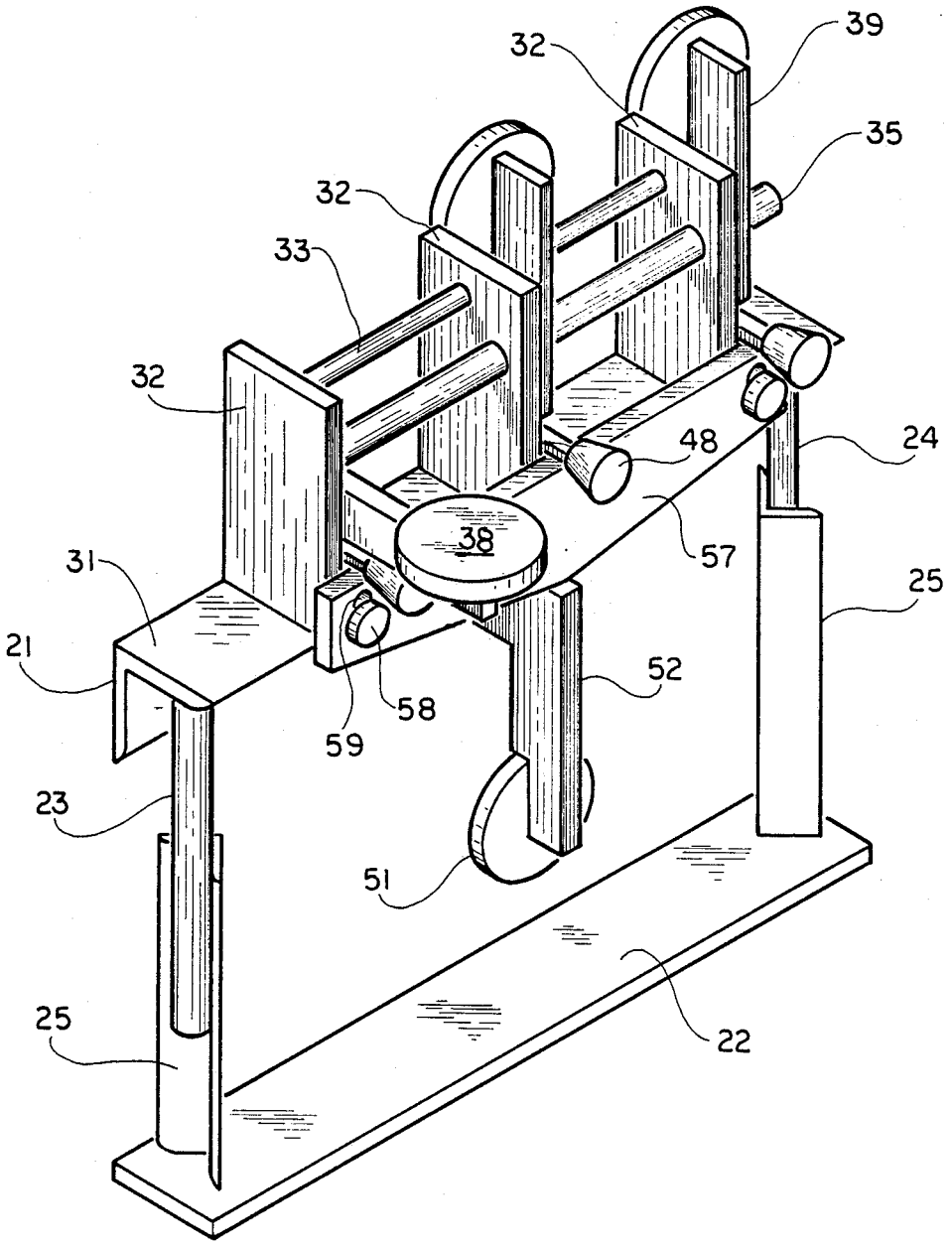
FIG. 2 shows a rear view of FIG. 1 with one target knocked down.
Figure 3:
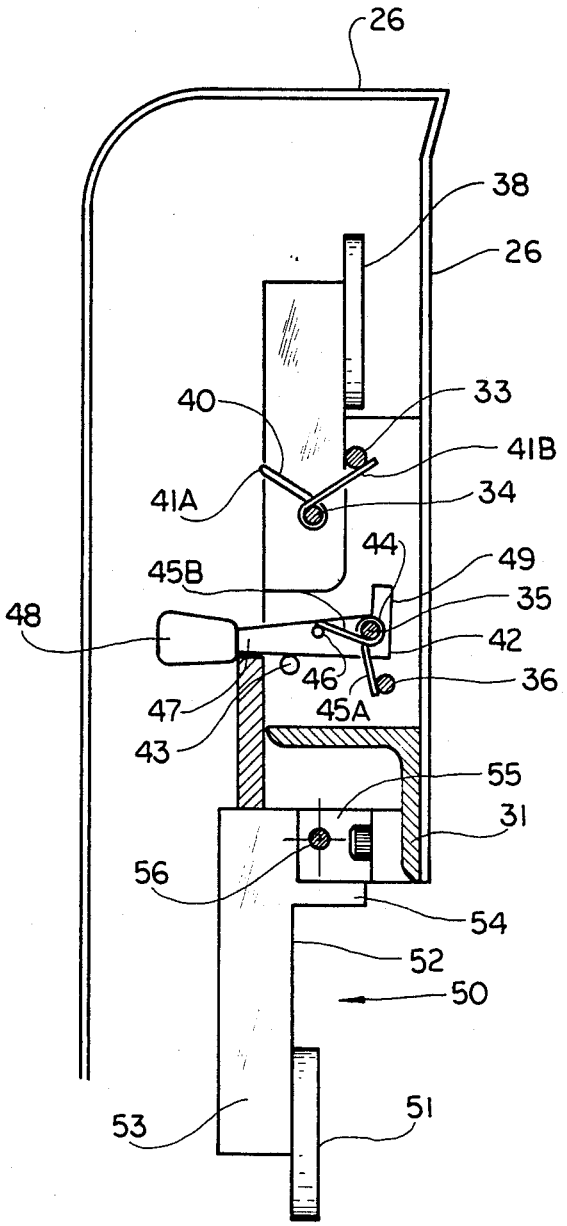
FIG. 3 shows the target assembly of the invention in section side view depicting the resetting means of the invention.
Figure 4A:
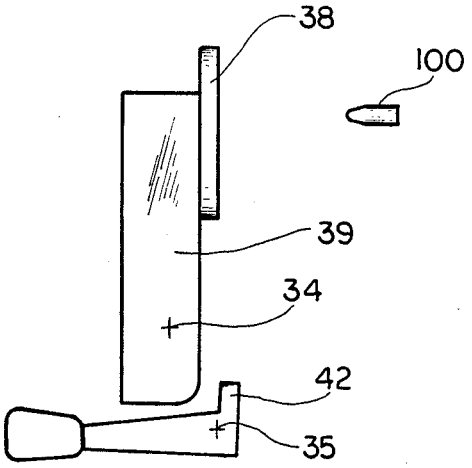
FIGS. 4 a-d show in progressive steps how the invention works.
Figure 4B:
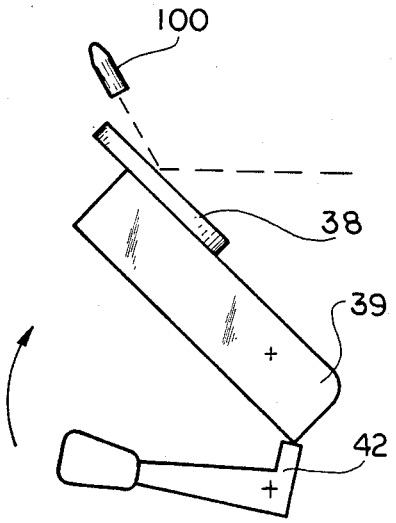
Figure 4C:
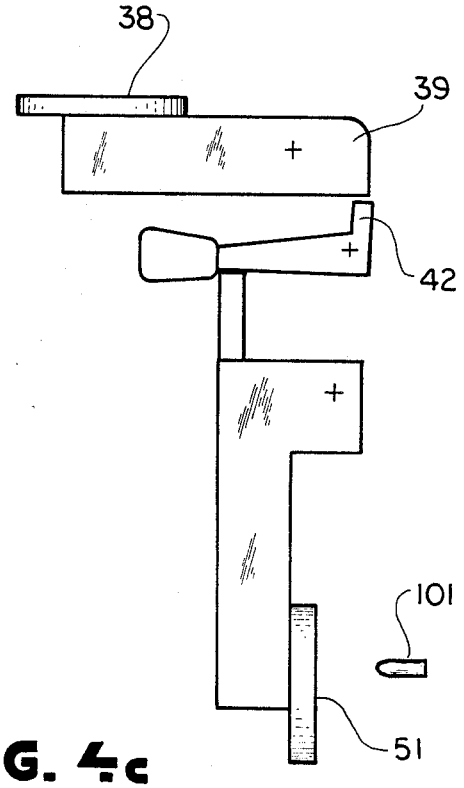
Figure 4D:
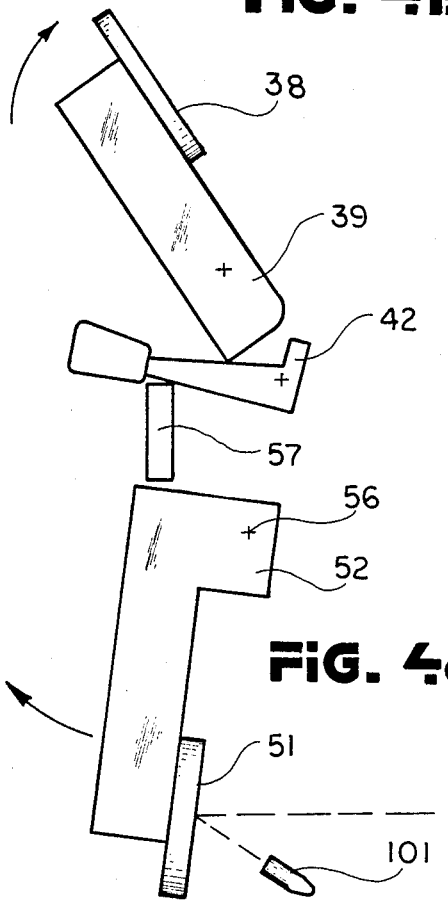

The preferred embodiment comprises a target array 10 on a frame 20, on which are mounted a multiplicity of target assemblies 40 and a reset target assembly 50.

The frame has an upper 21 removable section which holds the target array and a lower 22 stationary base section. The upper section is comprised of a right guide 23 and a left guide 24 which hold the upper section slidably in place on the base by means of upright holders 25 all of which facilitates the removal of the array for maintenance and storage.

The upper section is covered typically by shroud means 26 (shown on FIG. 1 in ghost) to protect the mechanism from stray projectiles and is comprised of a main array support 31 upon which are disposed uprightly perpendicular to the support a multiplicity of holding plates 32 equally spaced apart. Running transversely through each of the plates is a target spring keeper rod 33, a first target pivot rod 34, a latch pivot rod 35 and a latch spring keeper rod 36.

A first target assembly is comprised of a replaceable target 38 mounted on a target arm 39 which pivots on the target pivot rod 34 cooperatively with a torsion target spring 40 disposed on the pivot rod 34 the spring having a first **41*a* and second 41*b* end. The first target spring end 41*a* is bent at a 90 degree angle (not shown) and is seated snugly at the bend in contact with the back of the target arm. The second target spring end is restrained by the spring keeper rod 33 such that when the target arm is pivoted on rod 34, the target spring 40** is put under torsional load.

Situated below the target arm and disposed pivotably on the latch pivot rod 35 adjacent to the holding plate is a latch 42 which is generally "L" shaped with a major arm 47 and a minor arm, the latch being set horizontally with the major arm resting on a latch stop 43. The latch cooperates with a torsion type latch spring 44 adjacent to the latch, the latch spring having a first end **45*a* in restrained engagement with the latch spring keeper rod and a second end 45*b* resting on a boss 46 attached to the latch's major arm such that when the major latch arm is moved pivotably upward the latch spring comes under load. Optionally, the latch may have fitted on its major arm end shock absorbing means 48**.

The reset target assembly 50 is comprised of a second target 51 mounted on an "L" shaped reset arm 52 having a major leg 53 and a minor leg 54. The reset arm is pivotably connected at the "L's" vertex to a clevis 55 by means of a pin 56, the clevis being mounted centrally on the underside of the main array support 31. Above the reset arm and resting on it is an elongated clearing bar 57 which is situated parallel to the main support and is of sufficient length to pass cooperatively under each latch 42 in the target array. The clearing bar is maintained horizontally and guided in vertical movement against the latches by pins 58 in slots 59.

Attention is directed to FIG. 4 *a-d*. In FIG. 4*b* a first projectile 100 knocks down a first target 38 causing its first arm 39 to be driven pivotably backward on rod 34. As the arm clears the latch 42 it causes the target spring (not shown) to come under load. The latch spring (not shown) is loaded momentarily by the latch's movement on the latch pivot rod 35 and is released after the first arm clears thereby restoring the latch to its horizontal position thereby latching the target arm (FIG. 4-c) in the knocked down position. A second projectile 101 striking the reset target 51 will cause the reset arm 52 on pin 56 to pivot thereby lifting the clearing bar 57 against the latch which lifts thereby permitting the target spring to release and reset the target upright as in FIG. 4*a*.

Since many modifications, variations and changes in detail may be made to the presently describe embodiment, it is intended that all matters in the foregoing description and accompanying drawings be interpreted as illustrative and not by way of limitation.

What is claimed is:

1. An improved target array comprising:

(a) a frame for holding a multiplicity of upright first target assemblies;

(b) a target assembly having a first target attached to a first pivoting target arm in cooperative contact with a target torsion spring means responsive to the arm pivot, the spring coming under load when the target and arm are knocked down;

(c) latch means to latch the arm in the knocked down position and restrain the load on the torsion spring;

(d) a reset target assembly having (1) a second target attached to a second pivoting arm for resetting, depending from the frame, (2) a clearing bar guidingly mounted on the frame, which is lifted by the reset arm's pivoting action to unlatch the first pivoting target arm thereby permitting the first target to be reset upright.

2. An improved target array as in claim 1 wherein the upright target assembly have targets which are replaceable.

3. An improved target array as in claim 1 wherein the frame is comprised of a removable section which holds the target assemblies and a stationary base section.

* * * * *